US010774992B2

(12) United States Patent
Oury

(10) Patent No.: US 10,774,992 B2
(45) Date of Patent: Sep. 15, 2020

(54) METHOD FOR SUPPLYING CRYOGENIC LIQUID, AND FACILITY FOR IMPLEMENTING SAID METHOD

(71) Applicant: CRYOSTAR SAS, Hesingue (FR)

(72) Inventor: Simon Oury, Saint Louis (FR)

(73) Assignee: CRYOSTAR SAS, Hesingue (FR)

( * ) Notice: Subject to any disclaimer, the term of this patent is extended or adjusted under 35 U.S.C. 154(b) by 176 days.

(21) Appl. No.: 15/765,578

(22) PCT Filed: Oct. 5, 2016

(86) PCT No.: PCT/FR2016/052566
§ 371 (c)(1),
(2) Date: Apr. 3, 2018

(87) PCT Pub. No.: WO2017/060627
PCT Pub. Date: Apr. 13, 2017

(65) Prior Publication Data

US 2018/0299072 A1 Oct. 18, 2018

(30) Foreign Application Priority Data

Oct. 5, 2015 (FR) ..... 15 59472

(51) Int. Cl.
*F17C 13/00* (2006.01)
*F17C 13/02* (2006.01)
(Continued)

(52) U.S. Cl.
CPC ..... *F17C 13/025* (2013.01); *F17C 6/00* (2013.01); *F17C 9/00* (2013.01); *F17C 13/028* (2013.01);
(Continued)

(58) Field of Classification Search
CPC .. F17C 13/025; F17C 6/00; F17C 9/00; F17C 13/028; F17C 2205/0335;
(Continued)

(56) References Cited

U.S. PATENT DOCUMENTS 5,549,142 A 8/1996 Beale
8,291,944 B2 * 10/2012 Allidieres ..... F17C 5/007 137/565.16
(Continued)

FOREIGN PATENT DOCUMENTS

CN 101968160 A 2/2011
CN 103470956 A 12/2013
(Continued)

OTHER PUBLICATIONS

International Search Report for PCT/FR2016/052566, Authorized Officer: Boris Nicol, dated Feb. 10, 2017, 5 pages.
(Continued)

*Primary Examiner* — P. Macade Nichols
(74) *Attorney, Agent, or Firm* — Millen White Zelano & Branigan, PC; Brion P. Heaney

(57) ABSTRACT

This method for dispensing cryogenic liquid includes the following steps:

Figure 1:
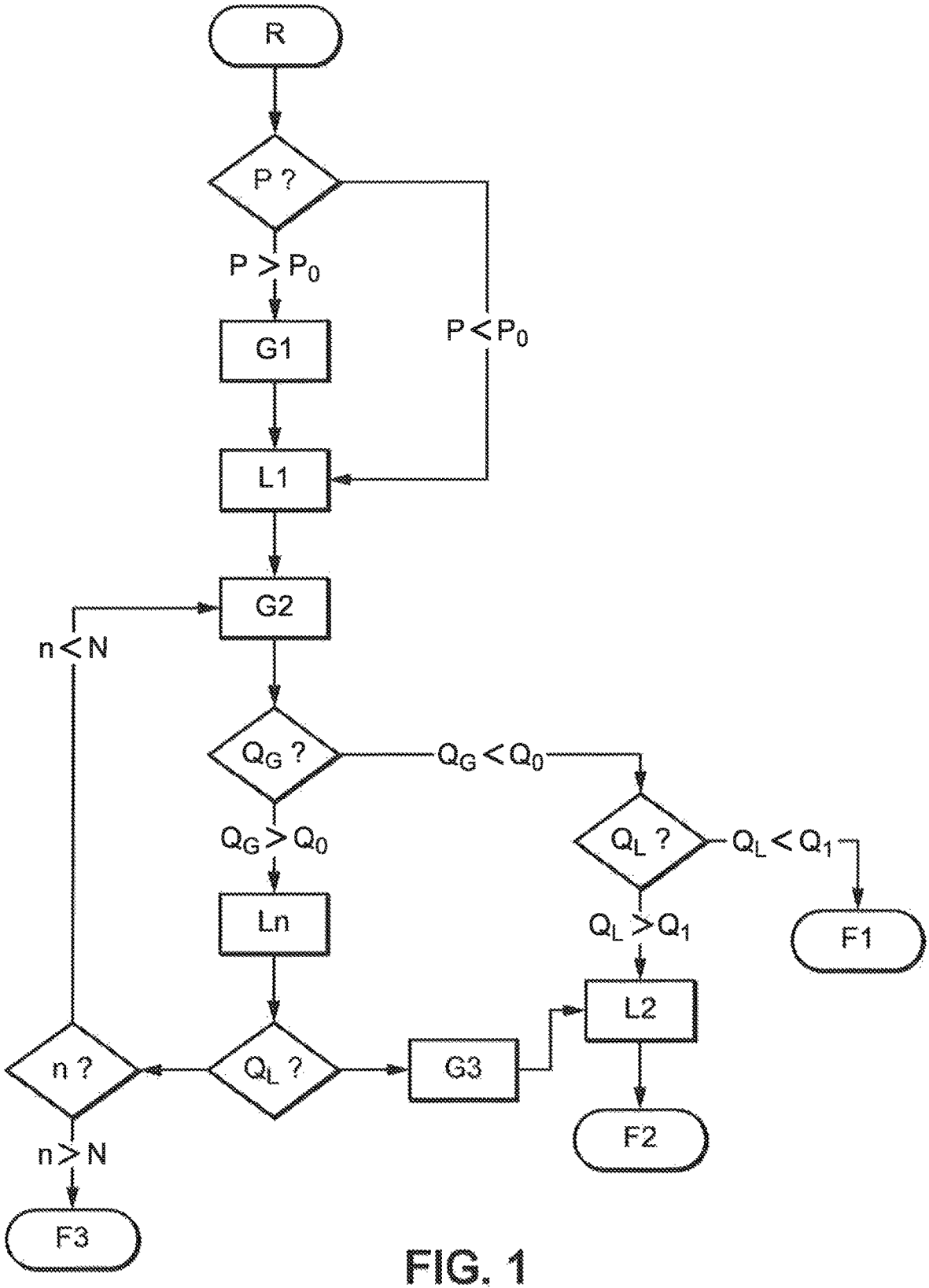

connecting, in a sealtight manner, a fuel tank (2) to be filled to a storage tank, dispensing cryogenic liquid to the fuel tank (2) and determining firstly the flow of liquid being dispensed and the amount of liquid dispensed, and secondly the pressure prevailing in the fuel tank (2), stopping the dispensing of the liquid when the pressure exceeds a first predetermined threshold or else when the flow of liquid drops below a second predetermined threshold, degassing the fuel tank (2) after stopping the dispensing, while determining the amount of gas removed from the fuel tank (2) during the degassing, and
(Continued)

determining whether or not liquid should be dispensed again on the basis of the amount of gas removed during the degassing.

12 Claims, 2 Drawing Sheets

(51) Int. Cl.
*F17C 6/00* (2006.01)
*F17C 9/00* (2006.01)

(52) U.S. Cl.
CPC ..... *F17C 2205/0326* (2013.01); *F17C 2205/0335* (2013.01); *F17C 2205/0364* (2013.01); *F17C 2205/0367* (2013.01); *F17C 2221/014* (2013.01); *F17C 2221/017* (2013.01); *F17C 2221/03* (2013.01); *F17C 2221/033* (2013.01); *F17C 2223/0161* (2013.01); *F17C 2223/033* (2013.01); *F17C 2223/046* (2013.01); *F17C 2225/0161* (2013.01); *F17C 2225/033* (2013.01); *F17C 2250/043* (2013.01); *F17C 2250/0439* (2013.01); *F17C 2250/0443* (2013.01); *F17C 2250/072* (2013.01); *F17C 2250/075* (2013.01); *F17C 2265/031* (2013.01); *F17C 2265/032* (2013.01); *F17C 2265/065* (2013.01); *F17C 2270/0139* (2013.01); *F17C 2270/0171* (2013.01); *F17C 2270/05* (2013.01)

(58) Field of Classification Search
CPC ..... F17C 2205/0364; F17C 2221/033; F17C 2225/0161; F17C 2225/033; F17C 2250/075; F17C 2265/031
See application file for complete search history.

(56) References Cited

U.S. PATENT DOCUMENTS

| | | | | |
|---|---|---|---|---|
| 2003/0070434 | A1* | 4/2003 | Shimada | F17C 3/00 62/45.1 |
| 2014/0261867 | A1 | 9/2014 | Lambrix et al. | |

FOREIGN PATENT DOCUMENTS

| | | | |
|---|---|---|---|
| FR | 3 006 742 | A1 | 12/2014 |
| JP | 63199998 | A | 8/1988 |
| JP | 2001301900 | A | 10/2001 |
| JP | 2008281109 | A | 11/2008 |
| JP | 2014047801 | A | 3/2014 |
| WO | WO 2014/064355 | A2 | 4/2014 |

OTHER PUBLICATIONS

Written Opinion for PCT/FR2016/052566, Authorized Officer: Boris Nicol, dated Feb. 10, 2017, 5 pages.
Notice of Opposition in corresponding EP16793944.6 dated Jul. 2, 2020 (pp. 1-82).
Consolidated list from corresponding EP16793944.6 dated Jul. 2, 2020 (1 page).

* cited by examiner

METHOD FOR SUPPLYING CRYOGENIC LIQUID, AND FACILITY FOR IMPLEMENTING SAID METHOD

The present invention relates to a method for dispensing cryogenic liquid, and to an installation for implementing this method.

The invention may relate to any type of cryogenic liquid, that is to say any liquid obtained by cooling gases (pure gases or gas mixtures), such as for example nitrogen, helium or natural gas (methane), to very low temperatures (generally lower than −100° C.).

For some uses of cryogenic liquids, the liquid is stored in a relatively large tank, and means are provided for dispensing relatively small amounts of liquid into containers, such as for example a fuel tank of a truck. What is thus created is a refueling station with a storage tank and pressurized distribution means that are tailored to the container to be filled, generally including a pump enabling cryogenic liquid to be transferred from the storage tank to a fuel tank of a vehicle. The invention also relates to the transfer of cryogenic liquid to another type of container, for example a cryogenic liquid cylinder or a Dewar flask. The term 'container' is understood hereinafter to mean any type of fuel tank or receptacle or the like designed to contain liquid, and more particularly in this case a cryogenic liquid. Furthermore, for ease of writing, liquid transfers (from the tank to a cylinder or a Dewar flask, for example) will be likened to A refueling (from the tank to a fuel tank of a vehicle).

Document FR-2 997 165 relates to a method for filling a fuel tank with a cryogenic liquid, from an upstream store, in which there is provision for a filling station through which a first path passes, linking the store to the fuel tank and enabling the transfer of cryogenic liquid from the store to the fuel tank, and a second path linking a gas output of the fuel tank to the filling station and enabling the gases that are to be evacuated from the fuel tank to be returned to the filling station, the second gas return line to the station not having an overflow valve but being equipped with a solenoid valve or with a plurality of solenoid valves positioned in parallel, which is/are normally closed, the filling being controlled by acting on the solenoid valve so as to open it for as long as necessary in such a way as to obtain a desired pressure difference Delta P (between store and fuel tank), and a final pressure value in the fuel tank in accordance with a desired setpoint value that is associated with the fuel tank under consideration that it is necessary to fill.

Document FR-3 006 742 discloses, for its part, a device for filling a fuel tank with a liquefied gaseous fuel at a cryogenic temperature, comprising a source fuel tank for storing gaseous fuel in liquid state at a cryogenic temperature, a supply conduit comprising a pump, the supply conduit comprising an upstream end connected to the source fuel tank and a downstream end comprising a connection intended to be connected to a fuel tank to be filled, the supply conduit comprising, downstream of the pump, a bypass portion passing inside the source fuel tank and comprising a submerged heat exchanger, the supply conduit comprising a bypass valve system designed to control the relative proportions of the pumped fluid passing and not passing into the bypass portion so as to regulate the temperature of the liquid supplied during filling, and the filling device comprises a cryogenic cooler linked to the source fuel tank for selectively liquefying the gas present in the source fuel tank.

In the case of filling a fuel tank of a vehicle, when the vehicle arrives at a station for dispensing cryogenic liquid, such as for example LNG (liquefied natural gas), in order to refuel, its fuel tank is sometimes pressurized on account of the evaporation of the cryogenic liquid in the fuel tank. Thus, before refueling, it is necessary to perform degassing, that is to say to remove gas from the fuel tank in order to lower the pressure inside the latter. Next, during refueling, cryogenic liquid is conveyed in pressurized form as far as the fuel tank. Generally, the distribution of liquid stops when one of the two following conditions is met: the pressure in the fuel tank exceeds a predetermined threshold, or the liquid flow rate drops below a predetermined threshold.

During refueling, two main phenomena influence the pressure prevailing in the fuel tank. The first tends to increase the pressure in the fuel tank, and the second tends to lower it. Specifically, when liquid fills the fuel tank, the volume available for the gas decreases, and the gas therefore compresses, increasing the pressure. By contrast, as the liquid introduced into the fuel tank is cold, an exchange of heat takes place with the gas, and the latter then partly condenses. The amount (mass or number of moles) of gas therefore decreases, tending to lower the pressure in the fuel tank.

More often than not, refueling is performed quickly. On account of this, the pressure drop (condensation of the gas) is limited, and an increase in the pressure in the fuel tank is observed more often than not. The distribution of liquid is in fact stopped because the pressure in the fuel tank exceeds a given threshold. On account of this, it may be the case that the distribution stops before the fuel tank has been filled correctly. In extreme cases, if the fuel tank is 'hot' before refueling, the cryogenic liquid that is introduced initially into the fuel tank will vaporize quickly, then causing the pressure in the fuel tank to rise sharply. Refueling may then be stopped as the pressure has exceeded the predetermined threshold, while the fuel tank is not full, or is even still almost empty.

Thus, as evident from the above, it is necessary to measure the pressure prevailing in a fuel tank that is being refueled. The flow rate of liquid entering into the fuel tank is itself also generally measured, if only to be able to bill the client, the owner of the refueled vehicle, for the cryogenic liquid that is supplied to him. As indicated above, it is sometimes (or often) necessary to remove gas from the fuel tank in order to lower the pressure in the latter. In order to take account of the amount of gas removed from the fuel tank during billing, it is also customary to measure the amount of gas evacuated from the fuel tank.

The aim of the present invention is thus to enable good filling of a fuel tank, that is to say to automatically fill the fuel tank to its nominal fill level, which may correspond for example to the maximum authorized fill level.

Another aim of the present invention is to make it possible to determine, with good accuracy, both the amount of liquid introduced into the fuel tank and the amount of gas removed therefrom.

Advantageously, implementing the present invention will incur an extra cost of preferably nothing with respect to a station for dispensing cryogenic liquid (in particular LNG).

Lastly, the time for refueling a fuel tank should not be substantially lengthened by implementing the invention.

To this end, the present invention proposes a method for dispensing cryogenic liquid, including the following steps:

connecting, in a sealtight manner, a fuel tank to be filled to a storage tank, dispensing cryogenic liquid to the fuel tank and determining firstly the flow of liquid being dispensed and the amount of liquid dispensed, and secondly the pressure prevailing in the fuel tank, stopping the dispensing of the liquid when the pressure exceeds a first predetermined threshold or else when the flow of liquid drops below a second predetermined threshold.

According to the present invention, the method furthermore includes the following steps:

degassing the fuel tank after stopping the dispensing, while determining the amount of gas removed from the fuel tank during the degassing, and determining whether or not liquid should be dispensed again on the basis of the amount of gas removed during the degassing and possibly of other parameters.

What is proposed here, in an original manner, is to perform degassing of the fuel tank after it has been filled. It has been noted that knowing the amount of gas removed from the fuel tank during the last degassing made it possible to have an idea as to the fill level of the fuel tank. It is therefore possible, using this information, to determine whether or not the fuel tank should still be filled. Use may also possibly be made of other information, such as for example the amount of cryogenic liquid supplied to the fuel tank during the last filling step: this amount is generally known. The amount of liquid dispensed and/or the amount of gas removed from the fuel tank may be determined through measurement, for example using a flowmeter, or else through estimation, for example on the basis of the dispensing or degassing time, the pressure of the fluid moreover being known.

In a method such as proposed above, it is advantageously provided that, as long as the amount of gas removed from the fuel tank is greater than a predetermined third threshold, a new dispensing of liquid with determination of the amount dispensed during this new dispensing, followed by degassing with determination of the amount of gas removed from the fuel tank, is performed. Next, if the amount of liquid dispensed during the dispensing of liquid is greater than a predetermined amount of liquid, then a new degassing operation may then be performed, possibly followed by a last step of dispensing liquid.

So as not to risk having an excessively long fuel tank filling duration and/or filling beyond the maximum authorized fill level, it is advantageously provided that the number of cryogenic liquid dispensing steps is limited.

In a method according to the present invention, a degassing operation may for example be stopped when the pressure in the fuel tank drops below a predetermined threshold and/or if an amount of gas, which amount is predetermined on the basis in particular of an amount of liquid dispensed and/or of an amount of gas removed during preceding steps, is removed from the fuel tank.

According to one preferred variant implementation, it may also be provided that, if the amount of gas removed during the last degassing operation performed and if the amount of cryogenic liquid dispensed during the last cryogenic liquid dispensing operation are both below predetermined thresholds, then the dispensing method is stopped.

The dispensing method may also for example be stopped if the amount of gas removed during the last degassing operation performed is below a predetermined threshold and if the amount of cryogenic liquid dispensed during the last cryogenic liquid dispensing operation is above a predetermined threshold, after a last dispensing of cryogenic liquid has then been performed.

The present invention also relates to an installation for dispensing cryogenic liquid, including a cryogenic liquid feed pipe and possibly a degassing pipe, characterized in that it furthermore includes a management system for implementing each of the steps of a method such as described above.

To this end, such a dispensing installation may include:

a cryogenic liquid feed pipe, means for dispensing cryogenic liquid, including means for connecting, in a sealtight manner, to a fuel tank, means for determining firstly a flow of liquid to the fuel tank, and secondly the pressure prevailing in said fuel tank, means for stopping the dispensing of the cryogenic liquid, means for degassing the fuel tank, means for determining the amount of gas removed from the fuel tank during degassing, and a management and control system acting firstly on the means for dispensing and for stopping the dispensing on the basis of the pressure of liquid in the fuel tank and/or else the flow of liquid dispensed to the fuel tank and/or the amount of gas removed during the preceding degassing, and secondly on the degassing means so as to control degassing of the fuel tank after at least one dispensing of cryogenic liquid.

According to a first embodiment, what is proposed is an installation including:

a cryogenic liquid feed line, a first valve positioned on the feed line, a first flowmeter positioned on the feed line, downstream of the first valve, a first flexible conduit downstream of the first flowmeter and intended to link the feed line to a fuel tank in order to dispense cryogenic liquid to the latter, a degassing line connected to the feed line between the first flowmeter and the first valve, and a second valve positioned on the degassing line.

In one preferred embodiment, which furthermore makes it possible to ensure good filling of a fuel tank and also to ensure accurate measurement of the liquid introduced into a fuel tank and of the gas removed therefrom, an installation according to the invention may include:

a cryogenic liquid feed line, a first valve positioned on the feed line, a first flowmeter positioned on the feed line, downstream of the first valve, a second valve positioned on the feed line, downstream of the first flowmeter, a first flexible conduit downstream of the second valve and intended to link the feed line to a fuel tank in order to dispense cryogenic liquid to the latter, a degassing line connected to the feed line between the first flowmeter and the second valve, a third valve positioned on the degassing line, and a second flexible conduit, termed degassing conduit, intended to be linked to the fuel tank in order to enable gas to be removed from the latter, said degassing conduit being linked to the feed line downstream of the second valve by way of a link.

To determine the amount of gas removed from the fuel tank during a degassing phase, it is proposed to equip the degassing line with a flowmeter.

Figure 2:
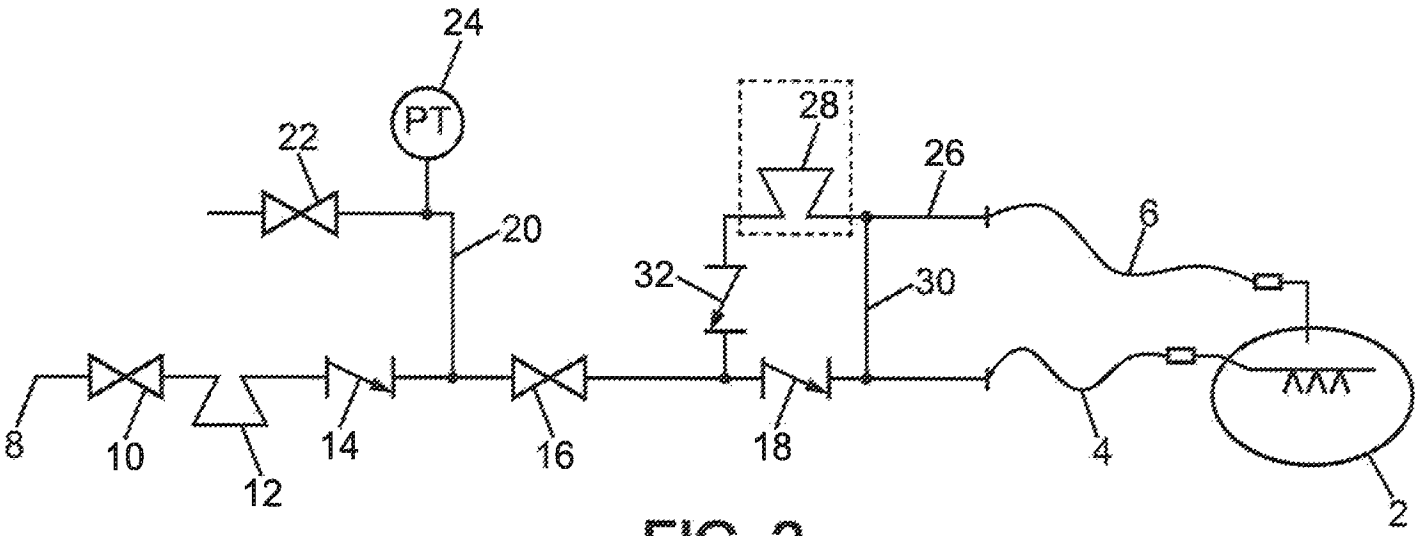
Figure 3:
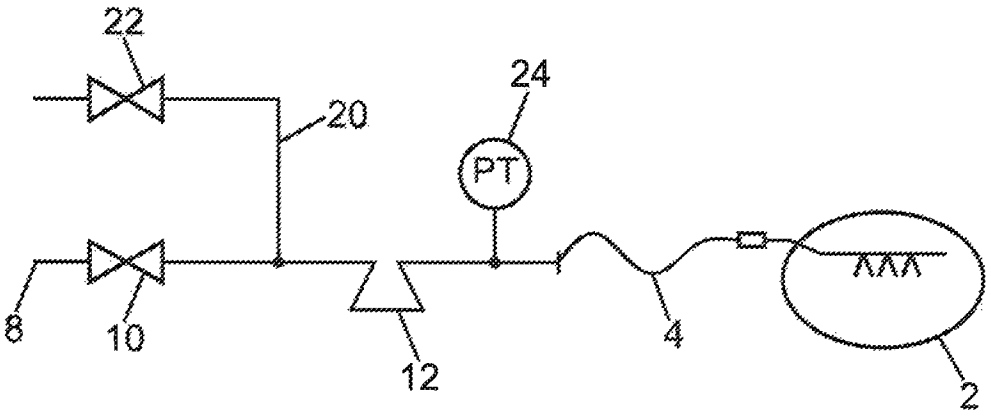

Details and advantages of the present invention will became better apparent from the description which follows, given with reference to the appended schematic drawing in which:

FIG. 1 is a flow chart illustrating a preferred variant implementation of a method according to the invention, FIG. 2 schematically illustrates an installation for dispensing cryogenic liquid, advantageously able to be used to implement the method illustrated in FIG. 1, and FIG. 3 schematically illustrates a dispensing installation for implementing the method illustrated in FIG. 1 and that is simplified in relation to that of FIG. 2.

The method described hereinafter is implemented when a fuel tank 2 is linked to a station for dispensing cryogenic liquid. The fuel tank 2 (cf. FIG. 2) may be a fuel tank of a vehicle or an independent receptacle (cylinder, Dewar flask, etc.). The cryogenic liquid is for example LNG (liquefied natural gas), but any other type of cryogenic liquid (liquid nitrogen, etc.) may be involved. By way of illustrative and non-limiting example, it will be assumed in the remainder of the description that the liquid dispensed in this case is LNG for feeding a truck fuel tank.

The first step R thus consists in this case in connecting the fuel tank 2 to a station for dispensing LNG. Said station allows the transfer of a limited amount of LNG from a storage tank (not shown) to smaller fuel tanks or the like. The link between the fuel tank 2 and the dispensing station is formed by a flexible pipe that has two conduits: a first conduit, termed feed conduit 4, which is intended to convey the LNG coming from the storage tank as far as the fuel tank 2 of the truck, and a second conduit, termed degassing conduit 6, intended to evacuate the elements in gaseous phase that are present in the fuel tank 2.

The user wishing to fill his fuel tank then requests this filling by pressing for example a button (not illustrated).

In order to be able to perform filling, it is first of all necessary to determine whether the pressure in the fuel tank 2 (step: P?). This pressure should be greater than the saturation pressure of the liquid (LNG) in order to prevent immediate evaporation of the liquid introduced into the fuel tank 2. This condition is more often than not met, as there is generally still liquid in the fuel tank 2. It should nevertheless also be ensured that this pressure is not excessively high. Specifically, if the pressure is too close to the maximum admissible pressure of the fuel tank or else if this pressure is too close to the maximum pressure able to be dispensed by the filling system, then liquid should not be sent to the fuel tank 2.

The method then provides a predetermined pressure ($P_0$) starting from which here is provision to perform degassing of the fuel tank 2.

Therefore, if the pressure P in the fuel tank 2 is thus greater than the predetermined pressure $P_0$ ($P>P_0$), then a degassing operation (step G1) is performed. During this operation, gas is removed from the fuel tank 2. The gas is returned to the cryogenic liquid network. The amount of gas removed is preferably measured. This measurement may be performed accurately with a flowmeter suited to the nature of the gas and to the measurement conditions. With the pressure of the gas being known (measured), along with the dimensions of the conduits and the downstream pressure, the amount of gas removed from the fuel tank 2 is able to be estimated on the basis of the duration of the degassing operation. Other methods may be used to determine the amount of gas removed from the fuel tank 2.

When the pressure in the fuel tank 2 has dropped back below the predetermined pressure $P_0$, then the filling of the fuel tank 2 with LNG may begin (step L1), As illustrated on the flow chart, this filling step is performed without prior degassing if the pressure in the fuel tank 2 is below $P_0$.

Before allowing LNG to enter the fuel tank 2, a step of cooling the system, not provided on the flow chart so as to make the latter simpler, may be necessary for cooling elements of the dispensing station and not to risk injecting gas into the fuel tank 2. This operation of cooling the system, also called cooling operation, will be described further on with reference to FIG. 2.

Generally, during the filling of the fuel tank 2 with LNG, the degassing is stopped even though the gas contained in the fuel tank 2 is not able to exit to the dispensing system and remains in the fuel tank 2. The amount of cryogenic liquid introduced into the fuel tank 2 is measured in order to know the amount dispensed so as to be able to establish a fair price for the transaction. In the case of an application in which the cryogenic liquid is not sold, it is possible to determine the amount of liquid dispensed through estimation, for example on the basis of the dispensing time and of the pressure of the liquid, the dimensions of the conduits being known through construction.

The filling operation (step L1, but also hereinafter the other filling/dispensing steps/operations that will be provided) stops when one of the two following conditions is met:

- the pressure in the fuel tank 2 reaches a first threshold value P1 and/or
- the liquid flow rate (for example expressed in liters per second l/s) drops below a second threshold D2.

The first threshold value P1 may correspond to the predetermined value $P_0$ defined previously, but another limit value may be involved.

The second threshold D2 is predetermined on the basis in particular of the nominal flow rate $D_n$ of the dispensing station. It may for example be provided that $D2=D_n/10$, that is to say that the dispensing of LNG stops when the liquid flow rate drops below 10% of the nominal flow rate.

The amount $Q_L$ of LNG distributed during this filling operation is preferably measured.

The method proposed here, in an original manner, provides for systematically performing a degassing step (step G2) after this first filling step (step L1). During this degassing step, the amount $Q_G$ of gas removed from the fuel tank 2 is measured and/or estimated. A flowmeter may measure the amount $Q_G$, but it is also possible to provide a measurement of the time that the degassing step lasts in order to estimate the amount $Q_G$ with fairly good accuracy. Other measurement or estimation methods may be contemplated.

The remainder of the method depends on the amount of gas removed from the fuel tank 2 during this degassing operation. If this amount is large, that is to say greater than a predetermined amount $Q_0$, it is estimated that there is still space in the fuel tank 2, and a new filling step may then be launched.

By contrast, if this amount of gas is small, that is to say smaller than the predetermined amount $Q_0$, the filling method may be terminated. In the latter case, as is able to be seen on the right-hand side of the flow chart, two ways of proceeding are proposed depending on the amount $Q_L$ of LNG that has been dispensed during the last filling step.

If this amount $Q_L$ of LNG was small, for example smaller than an amount $Q_1$, then the process for dispensing cryogenic liquid is terminated (step F1). The present case corresponds for example to a fuel tank 2 that was already virtually full when it was connected to the dispensing station before the filling operation.

By contrast, if the amount $Q_L$ of LNG dispensed during the last filling step was greater than the amount $Q_1$, then there is provision to proceed to a final filling step (step L2) before terminating the filling method (step F2).

If the amount $Q_G$ of gas is greater than the amount $Q_0$, then a new filling step (step Ln) is launched, during which the amount $Q_L$ of cryogenic liquid is measured. As long as the amount $Q_L$ remains lower than the predetermined amount $Q_1$, there is provision to repeat the degassing operation provided in step G2. A loop is thus created in which filling and degassing operations follow one another as long as the amount of gas removed from the fuel tank 2 remains greater than the predetermined value $Q_0$ and the amount of liquid transferred to the fuel tank 2 remains smaller than the predetermined value $Q_1$.

To avoid lengthening the duration of filling the fuel tank 2 and/or filling the fuel tank 2 beyond the recommended maximum level, it is proposed to terminate this loop after a number N of loops. There is therefore provision, in a system for managing the filling method, to increment a number that counts the number of filling operations carried out. If the number N is reached through incrementation, the filling method is terminated after the Nth filling step.

For the sake of simplicity, the flow chart of FIG. 1 does not manage the setting and the incrementation of the number of filling/degassing loops.

In most cases, the loop on the left-hand side of FIG. 1 outlined above is performed only once. Specifically, it is unlikely (but able to be contemplated) for the amount of gas removed to remain high during several successive degassing operations, even if filling operations are carried out between two degassing operations. The latter scenario would correspond for example to a relatively 'hot' fuel tank. Thus, more often than not, during a second or possibly a third filling step (steps Ln), the amount $Q_L$ of liquid introduced into the fuel tank 2 drops below the threshold $Q_1$, and the filling method may thus be terminated. Since the last degassing operation led to the removal of a relatively large amount of gas, a final degassing step (step G3) is performed, followed by a last filling step (corresponding to step L2 described above). The filling process thus also ends in this case at the final step F2, which corresponds to the end of a 'normal' filling of the fuel tank 2.

During each final step (steps F1, F2 and F3), the flexible pipe with the filling conduit 4 and the degassing conduit 6 may then be decoupled from the fuel tank 2.

FIG. 2 schematically illustrates a dispensing station for implementing the method that has just been presented.

In FIG. 2, on the right-hand side thereof, the fuel tank 2 that has already been outlined and the flexible pipe linking this fuel tank to the dispensing station are seen. The latter includes first of all a cryogenic liquid feed line 8 that links the storage tank (not shown) containing the LNG reserve to the feed conduit 4.

A first valve 10 is positioned on the feed line 8 and makes it possible to control the arrival of cryogenic liquid into the dispensing system.

A first flowmeter 12 is positioned on the feed line 8, downstream of the first valve 10, in order to measure the amount of LNG fed to the dispensing system. Downstream of this flowmeter is a non-return valve 14 that prevents any return of cryogenic liquid or gas to the storage tank.

A second valve 16 is then positioned on the feed line 18, downstream of the first flowmeter 12.

Lastly, another non-return valve 18 on the feed line 8 before the junction thereof with the flexible pipe, and more precisely the feed conduit 4 of this flexible pipe, is provided in order to prevent any return of liquid but also of gas to this portion of the feed line 8.

The dispensing system shown in FIG. 2 also includes a degassing line formed of a plurality of sections.

A first section 20 of the degassing line connects the feed line 8 between the non-return valve 14 and the second valve 16 to a conduit, not shown, that makes it possible to reinject the gas to the storage tank or to another recovery system, or even possibly to a combustion device. A third valve 22 controls the gas flow rate in this first section 20. A measurement device 24 makes it possible to know the pressure and the temperature of the gas in this first section 20.

A second section 26 of the degassing line links the feed line 8 to the flexible pipe, and more particularly to the degassing conduit 6. This second section 26 is connected to the feed line 8, downstream of the second valve 16. A second flowmeter 28 is situated on this second section 26.

Inside the dispensing system, a link 30 makes the second section 26 communicate with the feed line 8 in the proximity of the feed conduit 4 and of the degassing conduit 6. The link 30 is connected to the second section 26, upstream of the second flowmeter 28, and to the feed line 8, downstream of the non-return valve 18.

A third non-return valve 32 is provided in the second section 26 between the second flowmeter 28 and the connection of the second section 26 to the feed line 8. It ensures that the gas flowing in this second section 26 is evacuated from the fuel tank 2.

The remainder of the present description indicates how the device that has just been described and as illustrated in FIG. 2 is able to be implemented to carry out steps of the method of FIG. 1.

At the outset, before the flexible pipe is connected to the fuel tank 2, the first valve 10 is closed so as to prevent LNG from flowing, whereas the second valve 16 and the third valve 22 are opened (continuously or alternately) so as to enable gas, coming for example from an evaporation of liquid present in the conduits, to return to the storage tank (or any other gas recovery system).

When the flexible pipe is connected to the fuel tank 2, the third valve 22 closes in order to control the flow rate of gas exiting the fuel tank 2. If a degassing operation (step G1) is provided, then this third valve 22 is opened so as to enable the gas to be removed from the fuel tank 2. The second flowmeter 28 then measures the amount of gas removed from the fuel tank 2.

It has been outlined above that, prior to the first filling step (step L1), an operation of cooling the dispensing system may have been contemplated in order to set the system to operating temperature. For this operation, LNG is admitted into the dispensing system by opening the first valve 10. The LNG then flows through the first flowmeter 12 and returns to the storage tank via the third valve 22. The second valve 16 remains closed during this cooling operation, and the control and management system associated with the dispensing system does not take account of the amount of LNG measured by the first flowmeter 12.

For a filling step (steps L1, L2 or Ln), the first valve 10 and the second valve 16 are opened so as to allow the LNG to pass via the feed line 8 from the storage tank to the fuel tank 2. The third valve 22 remains closed so as to prevent gas from returning to the storage tank during the filling steps.

At the end of a filling step, the first valve 10 is closed first of all, and then the second valve 16. A delay is provided for the liquid remaining in the line to evaporate. It is hence ensured that the flexible pipe is only handled when it contains gas, thereby improving the safety of the dispensing system. The delay is determined in this case on the basis of parameters linked to the dispensing station, from calculations and/or experimental tests.

Next, during an operation of degassing the fuel tank 2, the first valve 10 is closed so that the dispensing system is no longer fed with cryogenic liquid, and the second valve 16 along with the third valve 22 are opened so as to enable the gas to flow to the storage tank (or other).

The present device may thus be used to guarantee good filling of the fuel tank 2 by implementing the method described above.

A simplified embodiment of the dispensing station of FIG. 2 is illustrated in FIG. 3. For the sake of simplicity, the references used in FIG. 2 are taken up in FIG. 3 to denote similar elements.

The dispensing station illustrated in this FIG. 3 first of all includes a cryogenic liquid feed line 8. It is linked to a storage tank (not shown).

To control the dispensing of cryogenic liquid to a fuel tank 2, a first valve 10 is positioned on the feed line 8. A first flowmeter 12 positioned on the feed line 8, downstream of the first valve 10, is used to measure the amount of liquid (LNG) dispensed. This dispensing is performed by a first flexible conduit 4 connected to the feed line 8, downstream of the first flowmeter 12.

To allow vaporized liquid to return, a degassing line 20 is connected to the feed line 8. The connection is made in this case between the first flowmeter 12 and the first valve 10. The flow of gas in the degassing line is controlled by a second valve 22 positioned on the degassing line 20.

The filling method makes it possible to guarantee nominal filling of the fuel tank. Degassing performed after a first filling operation makes it possible to estimate whether the fuel tank is sufficiently full, with knowledge of the amount of gas removed during the degassing and advantageously also the amount of liquid transferred into the fuel tank. If a large amount of liquid has been transferred and little gas has been removed, the fuel tank is probably full, and just a top-up is performed.

On the other hand, if a small amount of liquid has been transferred to the fuel tank but a lot of gas has been removed therefrom, it may be assumed that the fuel tank was 'hot' and that the liquid introduced into the fuel tank evaporated quickly.

The proposed method thus makes it possible to manage intermediate situations between these two situations.

The proposed device makes it possible to implement the method according to the invention. It furthermore makes it possible to accurately measure the amount of LNG supplied to the client by also taking account of the gas removed from the fuel tank. This device and this method may thus be used for commercial transactions.

Guaranteeing good filling of a fuel tank for a truck makes it possible to guarantee a maximum degree of autonomy therefor.

The proposed system is also a safe system in which there is provision in particular for handling the pipe for connection to the fuel tank only when the latter is full of gas (not of liquid).

Of course, the present invention is not limited to the embodiment of the installation illustrated in the drawing, to the variants outlined in the above description and to the method described above. It also relates to any variant implementations within the scope of those skilled in the art in the context of the claims hereinafter.

The invention claimed is:

1. A method for dispensing cryogenic liquid, comprising:

connecting in a sealtight manner a fuel tank to a storage tank, dispensing cryogenic liquid from the storage tanks to the fuel tank, the dispensing comprising determining a flow of the cryogenic liquid being dispensed and an amount of the cryogenic liquid being dispensed, and determining a pressure prevailing in the fuel tank, stopping the dispensing of the cryogenic liquid when the pressure in the fuel tank exceeds a first predetermined threshold or when the flow of cryogenic liquid being dispensed drops below a second predetermined threshold, degassing the fuel tank after the stopping of the dispensing, and determining an amount of gas removed from the fuel tank during the degassing, and determining whether cryogenic liquid should be dispensed again from the storage tank to the fuel tank depending upon a parameter selected from the amount of the gas removed from the fuel tank during the degassing, and other parameters of the method.

2. The method of claim 1, further comprising:

if the amount of the gas removed from the fuel tank is greater than a predetermined third threshold, performing a new dispensing of the cryogenic liquid and determining the amount of cryogenic liquid dispensed during the new dispensing, and subsequently degassing the fuel tank with determination of the amount of the gas removed from the fuel tank (2) during degassing.

3. The method of claim 2, further comprising:

if the amount of the liquid dispensed during the dispensing of the liquid is greater than a predetermined amount of the liquid, then a new degassing operation is performed, followed by a last step of dispensing liquid.

4. The method of claim 1, further comprising limiting the number of times the dispensing of the cryogenic liquid is to occur.

5. The method of claim 1, further comprising stopping a degassing operation when the pressure in the fuel tank drops below a predetermined threshold and/or when a predetermined amount of gas is removed from the fuel tank, said predetermined amount of gas is predetermined on the basis of an amount of liquid dispensed to the fuel tank and/or of an amount of gas removed from the fuel tank during preceding dispensing and degassing steps.

6. The method of claim 1, further comprising stopping the dispensing method when the amount of gas removed during the previous degassing performed and amount of cryogenic liquid dispensed during the previous cryogenic liquid dispensing are both below predetermined thresholds.

7. The method of claim 1, further comprising performing a last dispensing of cryogenic liquid and stopping the dispensing method when the amount of gas removed during the previous degassing performed is below a predetermined threshold and when the amount of cryogenic liquid dispensed during the previous cryogenic liquid dispensing operation is above a predetermined threshold.

8. The method according to claim 1, wherein said determining whether the dispensing of the cryogenic liquid should be dispensed again is dependent upon the amount of the gas removed from the fuel tank during the degassing.

9. An installation for dispensing cryogenic liquid comprising:

a cryogenic liquid feed pipe, means for dispensing the cryogenic liquid, means for connecting in a sealtight manner the cryogenic liquid feed pipe to a fuel tank, means for determining a flow of the cryogenic liquid to the fuel tank, means for determining a pressure prevailing in the fuel tank, means for stopping the dispensing of the cryogenic liquid, means for degassing the fuel tank, means for determining an amount of gas removed from the fuel tank during the degassing, and a management and control system for (a) acting at least one of the means for dispensing and the means for stopping the dispensing on the basis of the pressure of the cryogenic liquid in the fuel tank, the flow of the cryogenic liquid dispensed to the fuel tank, and the amount of the gas removed during the preceding degassing, and (b) acting on the degassing means to control the degassing means of the fuel tank after at least one dispensing of the cryogenic liquid.

10. The installation of claim 9, wherein said means for dispensing the cryogenic liquid comprises a cryogenic liquid feed line, a first valve positioned at the cryogenic liquid feed line, and a first flowmeter positioned at the cryogenic liquid feed line downstream of the first valve, and wherein said cryogenic liquid feed pipe includes a first flexible conduit positioned downstream of the first flowmeter, the first flexible conduit linking the cryogenic liquid feed line to the fuel tank to dispense the cryogenic liquid to the fuel tank, and wherein said means for degassing the fuel tank comprises a degassing line connected to the cryogenic feed line between the first flowmeter and the first valve, and a second valve positioned at the degassing line.

11. The installation of claim 10, wherein said means for degassing the fuel tank further comprises a second flowmeter positioned at the degassing line for measuring a gas flow rate.

12. The installation of claim 9, wherein said means for dispensing the cryogenic liquid comprises a cryogenic liquid feed line, a first valve positioned at the cryogenic liquid feed line, a first flowmeter positioned at the cryogenic liquid feed line downstream of the first valve, a second valve positioned at the cryogenic liquid feed line downstream of the first flowmeter, and wherein said cryogenic liquid feed pipe includes a first flexible conduit positioned downstream of the second valve, the first flexible conduit linking the cryogenic liquid feed line to the fuel tank in order to dispense the cryogenic liquid to the fuel tank, and wherein said means for degassing the fuel tank comprises a degassing line connected to the cryogenic liquid feed line between the first flowmeter and the second valve, a third valve (22) positioned at the degassing line, and a second flexible degassing conduit linked at one end to the fuel tank in order to enable removal of gas from the fuel tank, and at another end to the cryogenic liquid feed line downstream of the second valve by a link.

* * * * *